US011950675B2

(12) United States Patent
Rabinovici

(10) Patent No.: US 11,950,675 B2
(45) Date of Patent: Apr. 9, 2024

(54) EYELASH SEPARATOR AND METHODS OF USE FOR REMOVING EXCESS MASCARA

(71) Applicant: Karen Rabinovici, Madison, CT (US)

(72) Inventor: Karen Rabinovici, Madison, CT (US)

( * ) Notice: Subject to any disclaimer, the term of this patent is extended or adjusted under 35 U.S.C. 154(b) by 0 days.

(21) Appl. No.: 17/578,362

(22) Filed: Jan. 18, 2022

(65) Prior Publication Data

US 2023/0292906 A1 Sep. 21, 2023

(51) Int. Cl.
*A45D 24/08* (2006.01)

(52) U.S. Cl.
CPC ..... *A45D 24/08* (2013.01); *A45D 2200/25* (2013.01)

(58) Field of Classification Search
CPC ..... A45D 2/48; A45D 8/04; A45D 19/012; A45D 24/08; A45D 24/10; A45D 24/36; A45D 26/0066; A45D 2200/25; B25F 1/04; B26B 11/001
USPC ..... D28/10, 31; D7/671
See application file for complete search history.

(56) References Cited

U.S. PATENT DOCUMENTS

| | | | | |
|---|---|---|---|---|
| 9,676,603 | B1 * | 6/2017 | Oakley | B67B 7/0423 |
| D852,653 | S * | 7/2019 | Zou | D10/57 |
| D955,900 | S * | 6/2022 | Yu | D10/57 |
| 2007/0186951 | A1 * | 8/2007 | Gueret | A45D 34/00 132/320 |
| 2013/0025071 | A1 * | 1/2013 | Keng | B25F 1/04 7/128 |
| 2016/0128447 | A1 * | 5/2016 | Lim | A45D 34/042 132/317 |
| 2017/0055662 | A1 * | 3/2017 | Taylor | A45C 11/324 |
| 2019/0209277 | A1 * | 7/2019 | To | A46B 15/0055 |
| 2020/0015570 | A1 * | 1/2020 | McGrath | A61Q 1/06 |
| 2020/0197141 | A1 * | 6/2020 | To | A61C 15/046 |
| 2021/0196022 | A1 * | 7/2021 | Boatman-Tate | A46B 5/04 |

OTHER PUBLICATIONS

Amazon, Lash Separator, Retrieved from Internet, URL: <https://a.co/d/1FXkAfK>, Retrieved on Jun. 20, 2023, available as early as Nov. 10, 2021.
LashLift Store, Lash and Eyebrow Comb, Retrieved from Internet, URL: <https://lashliftstore.com/products/perfect-lash-lift-comb>, Retrieved on Jun. 20, 2023, available as early as Nov. 10, 2021.
BlueMercury, Lash Styler, Retrieved from Internet, URL: <https://bluemercury.com/products/lash-star-lash-styler>, Retrieved on Jun. 20, 2023, available as early as Nov. 10, 2021.

(Continued)

*Primary Examiner* — Cris L. Rodriguez
*Assistant Examiner* — Karim Asqiriba
(74) *Attorney, Agent, or Firm* — Wiggin and Dana LLP

(57) ABSTRACT

Provided for are devices and methods for separating eyelashes and/or removing excess mascara, such as after application of mascara which results in undesirable clumps and/or excess mascara. The devices include a pin effective for breaking up or removing the clumps and/or removing excess mascara. Advantageously, the devices include a pivotable pin storable within a storage cavity of a housing or handle for safety and portability. The pin may be lockable or positionable in one or more positions for ergonomic and safe positioning for use near the eye.

18 Claims, 12 Drawing Sheets

(56) References Cited

OTHER PUBLICATIONS

Ulta Beauty, Airbrush Brow/Lash Styler #118, Retrieved from Internet, URL: <https://www.ulta.com/p/airbrush-browlash-styler-118-xlslmpprod11061160>, Retrieved on Jun. 20, 2023, available as early as Nov. 10, 2021.
Amazon, Eye Lash Separator, Retrieved from Internet, URL: <https://a.co/d/dEhoa4a>, Retrieved on Jun. 20, 2023, Date First Available Apr. 15, 2021.
Amazon, Eye Lash Separator Tool, Retrieved from Internet, URL: <https://a.co/d/dCGFC7T>, Retrieved on Jun. 20, 2023, Date First Available Apr. 14, 2021.
LashLift Store, Lash Separator, Retrieved from Internet, URL: <https://lashliftstore.com/products/lash-bomb-ultimate-lifting-tool>, Retrieved on Jun. 20, 2023, available as early as Nov. 10, 2021.

* cited by examiner

EYELASH SEPARATOR AND METHODS OF USE FOR REMOVING EXCESS MASCARA

TECHNICAL FIELD

Provided for are devices and methods for separating eyelashes, such as after application of mascara which results in undesirable clumps of eyelashes, and/or for the removal of excess mascara. The devices include a pin effective for breaking up or removing the clumps and/or removing excess mascara. Advantageously, the devices include a pivotable pin storable within a storage cavity of a housing or handle for safety and portability. The pin may be lockable in one or more positions for ergonomic and safe positioning for use near the eye.

BACKGROUND

When mascara is applied to one's eyelashes, extensive clumping of eyelashes or excess mascara often occurs resulting in an undesired appearance. In order to remedy the clumping, eyelashes must be manually separated and excess mascara must be manually removed until the desired appearance is obtained.

One device type for manual separation of eyelashes and/or removal of excess mascara following the application of mascara is a comb-type device having metal or fibrous teeth or bristles grouped at the end of an elongated handle for the user to hold while using the device. Such devices have several disadvantages. For one, the devices are not portable or suitable for use away from the home or for travel. The elongated handle and delicate teeth or bristles impose a challenge for carrying the device outside of the home without damaging the teeth or bristles. The teeth or bristles must also be protected by a separate cap or covering which can be easily misplaced. The elongated shape is also unsuitable for carry in many travel bags, purses, etc. Furthermore, the user has limited control over the degree of de-clumping and/or removal of excess mascara due to a large portion of the eyelashes or the entire set of eyelashes being perturbed in a single stroke.

Because of these deficiencies with comb-type devices, mascara wearers may instead opt for a more controllable and portable option. Particularly, a single pin may be useful for optimal control over de-clumping and removal of excess mascara, but there is no existing option which is both safe and portable. Therefore, there exists a need for an eyelash separator having a single separator pin and which is also safe and portable. When not in use, the pin should be storable in a retracted or internally folded position within a housing. An internally folded position within the housing, such as a cavity therein, provides sanitary and damage protection to the pin and eliminates the need for a further cap or covering for device portability. The device should prevent accidental deployment of the pin when in storage or not in use. An aspect of safety includes that the device must be ergonomic to the hand and safely maneuverable near the human eye to de-clump eyelashes and/or remove excess mascara. The pin should also be positionable in a plurality of positions for optimal control. The housing should be large enough to be firmly and ergonomically grasped while being small enough to be portable and useful for travel and use away from the home. The present disclosure provides for such eyelash separator devices, and methods of using such devices to separate eyelashes and/or remove excess mascara following the application of mascara.

SUMMARY

Generally disclosed are eyelash separator devices and methods of use thereof. In an embodiment, the disclosure is directed to an eyelash separator, comprising: a housing having an internal storage cavity aligned with a pivot plane defined by a pivot axis of a hinge member; a pin coupled with the hinge member and pivotable along the pivot plane between a closed position and a plurality of open positions, wherein the pin is contained within the storage cavity of the housing in a closed position and deployed from the storage cavity in the plurality of open positions; and a projection disposed on the hinge member.

In some embodiments, the hinge member is disposed on a first end of the housing and a second end of the housing terminates beyond the end of the storage cavity.

In some embodiments, the hinge member and pin coupled thereto are lockable in one or more positions defined by an angle between the housing and the pin along the pivot plane.

In some embodiments, the hinge member and pin coupled thereto are lockable in one or more of a closed position, 45 degrees, 90 degrees, 135 degrees, and 180 degrees.

In some embodiments, the device further comprises a hinge locking mechanism

In some embodiments, the hinge member and pin coupled thereto are lockable in one or more positions defined by an angle between the housing and the pin along the pivot plane.

In some embodiments, the device further comprises a ball-and-click mechanism coupled with the hinge member.

In some embodiments, the hinge member and pin coupled thereto are positionable in one or more positions defined by an angle between the housing and the pin along the pivot plane, and wherein one or more depressions on an internal portion of the hinge member releasably engage with a ball and a spring of the ball-and-click mechanism to define the one or more positions.

In some embodiments, the hinge member and pin coupled thereto are lockable in one or more of a closed position, 45 degrees, 90 degrees, 135 degrees, and 180 degrees.

In some embodiments, the hinge member and pin coupled thereto are continuously positionable along the pivot plane.

In some embodiments, the device further comprises a limit stop.

In some embodiments, the continuous positioning is defined at one end by the closed position and at another end by a limit stop.

In some embodiments, the housing, hinge member, and projection are each constructed from a material independently selected from the group consisting of plastic, metal, recycled plastic, biodegradable plastic, wood, and combinations thereof.

In some embodiments, the housing, hinge member, and projection are coated with a no-slip grip.

In some embodiments, the pin member is formed of a material selected from the group consisting of metal, stainless steel, surgical steel, plastic, rubber, silicon, and combinations thereof.

In some embodiments, the pin member terminates in an end selected from the group consisting of a tapered point, a tapered and blunted point, a bladed end, a bladed and pointed end, a bladed and blunted end, a curved tapered point, a curved tapered and blunted point, and a curved bladed end.

In some embodiments, the pin member is formed of a metal with an end formed from a flexible material.

In some embodiments, the pin member is removably engaged with the hinge member.

In further embodiments, provided for is a kit comprising: an eyelash separator comprising: a housing having an internal storage cavity aligned with a pivot plane defined by a pivot axis of a hinge member; a pin coupled with the hinge member and pivotable along the pivot plane between a closed position and a plurality of open positions, wherein the pin is contained within the storage cavity of the housing in a closed position and deployed from the storage cavity in the plurality of open positions; and a projection disposed on the hinge member; and one or more additional pins to replace the removably engaged pin.

In further embodiments, provided for is a method comprising: applying mascara to the eyelashes of an eye, wherein the application of the mascara results in the formation of one or more eyelash clumps and/or results in excess mascara that requires removal; opening an eyelash separator comprising: a housing having an internal storage cavity aligned with a pivot plane defined by a pivot axis of a hinge member; a pin coupled with the hinge member and pivotable along the pivot plane between a closed position and a plurality of open positions, wherein the pin is contained within the storage cavity of the housing in a closed position and deployed from the storage cavity in the plurality of open positions; and a projection disposed on the hinge member, from a closed position to any one of the plurality of open positions; placing the pin behind or within a clump and/or the excess mascara; and pulling the device and pin away from the eye to break up the clump and/or remove the excess mascara.

In some embodiments, the method further comprises repeating the steps on one or more additional clumps and/or on another portion of excess mascara.

In some embodiments, the method further comprises one or more sanitization steps to sanitize the pin.

In an alternative embodiment, an eyelash separator device comprises a housing defined by a first end having a semicircular, rounded, flat, rectangular, polygonal, or any other suitable profile and a second end having a semicircular, rounded, flat, rectangular, polygonal, or any other suitable profile connecting to define a top, a bottom, a first side, and a second side, wherein the top comprises a cavity along a dimension between the first and the second end, wherein the first end has a hinge member defining a part of the end such that a portion of the first side and a portion of the second side sandwich a portion of the hinge member at the first end, the hinge member pivotable therebetween, the hinge member coupled with a pin contained within the storage cavity of the housing in a closed position and deployed from the storage cavity in a plurality of open positions, wherein the pin and hinge member are pivotable along a pivot plane parallel with the first and second sides, wherein the hinge member is coupled with a projection to allow the pin to be deployed from the closed position, wherein the housing comprises a depression to accommodate at least a portion of the projection in a closed position, wherein the projection is a formed as a part of the hinge member and limits the pivot range of the hinge member in a fully open position by interfering with a portion of the first end or bottom, and wherein the hinge member is coupled with an internal ball-and-click mechanism defining a plurality of open positions.

In another embodiment, the pin comprises a cylindrical shaft having a defined length, such as about ½", ¾", 1", 1¼", 1½", 1¾", 2", 2¼", 2½", 2¾", or 3", terminated with any tip described herein such as a pointed tip, a blunted tip, a bladed tip, a curve tip, or a hooked tip, optionally where the tip is constructed from a metal or flexible material. A shaft may be metal or any sufficiently rigid material, such as a plastic, such that the shaft does not easily bend during use. A pointed tip may be conical in shape. A blunted tip may be rounded or may have a frustro-conical shape.

In another embodiment, the device comprises a deployable member consisting of a single pin. If the device comprises a deployable member consisting of a single pin, the pin would be the only tool or deployable piece of the device, with the exception of the hinge member and projection coupled therewith which rotate with respect to the housing along with the pin or deployable member. Furthermore, if the device comprises a deployable member consisting of a single pin, the device would specifically exclude any other deployable member, such as a knife, corkscrew, screwdriver, bottle opener, awl, punch, scissors, blade or any other type of deployable member which could theoretically be deployably stored in a cavity.

DETAILED DESCRIPTION

While some specific embodiments will be shown and described, it will be understood that such disclosure is not intended to be limiting, but rather, the disclosure is intended to cover all modifications and alternate constructions falling within the spirit and scope of the embodiments described herein.

Figure 1:
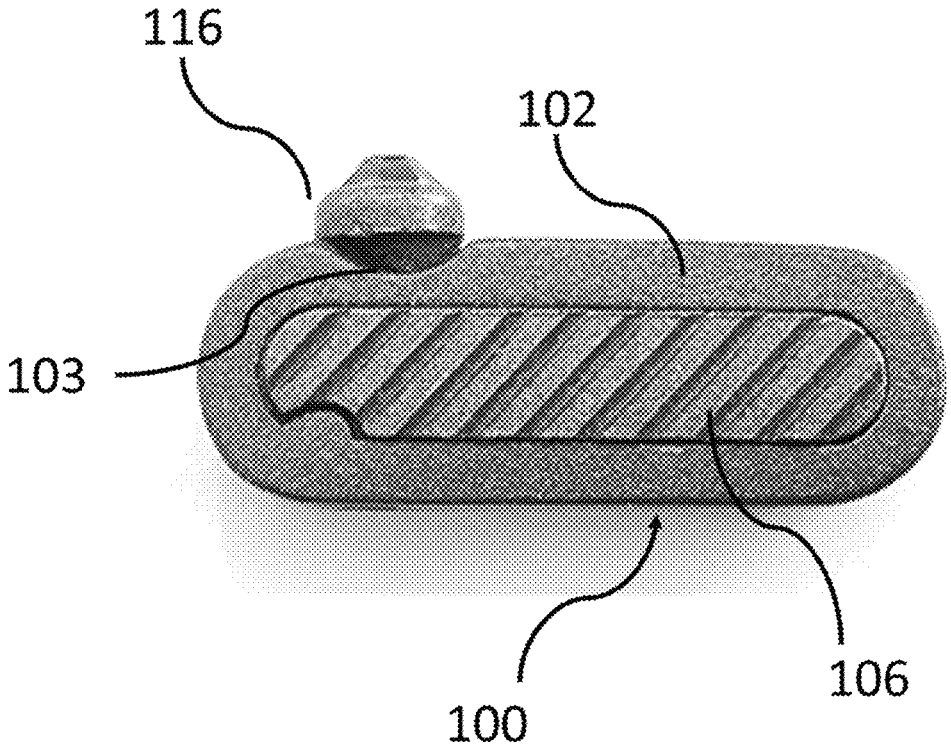
FIG. 1 depicts a front side view of an exemplary embodiment of an eyelash separator in a closed position.

FIG. 1 depicts an exemplary embodiment of an eyelash separator 100 in a closed position. In the closed side-view, the housing 102 is visible as well as the knob or projection 116 that is coupled to the internally housed separator pin. It can be appreciated that the housing may have any shape, contour, or design. The housing may be constructed from any suitable material, including plastics, recycled plastics, metal, recycled metals, biodegradable plastics, acrylic, and/or combinations thereof. In some embodiments, the housing is further coated with a further material such as a no-slip grip. Alternatively, or in addition to the no-slip grip, the housing may have one or more textures so as to further prevent slippage from the hand. In some embodiments, the housing has an inlaid or protruding texture pattern 106. In some embodiments, the texture pattern 106 is formed onto a cover plate or panel coupled with or adhered to the side of the housing 102. In some embodiments, the housing may include a depression or concave feature 103 near the knob such that a finger can easily access the bottom of the knob to open the device.

The knob or projection 116 may be constructed from any suitable material, including plastics, recycled plastics, metal, recycled metals, biodegradable plastics, acrylic, and/or combinations thereof. In some embodiments, the knob also has a no-slip grip and/or texture. The knob may be accented with a jewel or design feature for visual and aesthetic appeal. In some embodiments, the knob may be accessible in the device's closed position due to a depression or concave feature 103 in the housing. In some embodiments, the knob may have one or more outwardly extending features for pressing against to open the device. The knob 116 may be referred to as a "projection" for opening the device and/or moving the pin between the plurality of positions.

Figure 2:
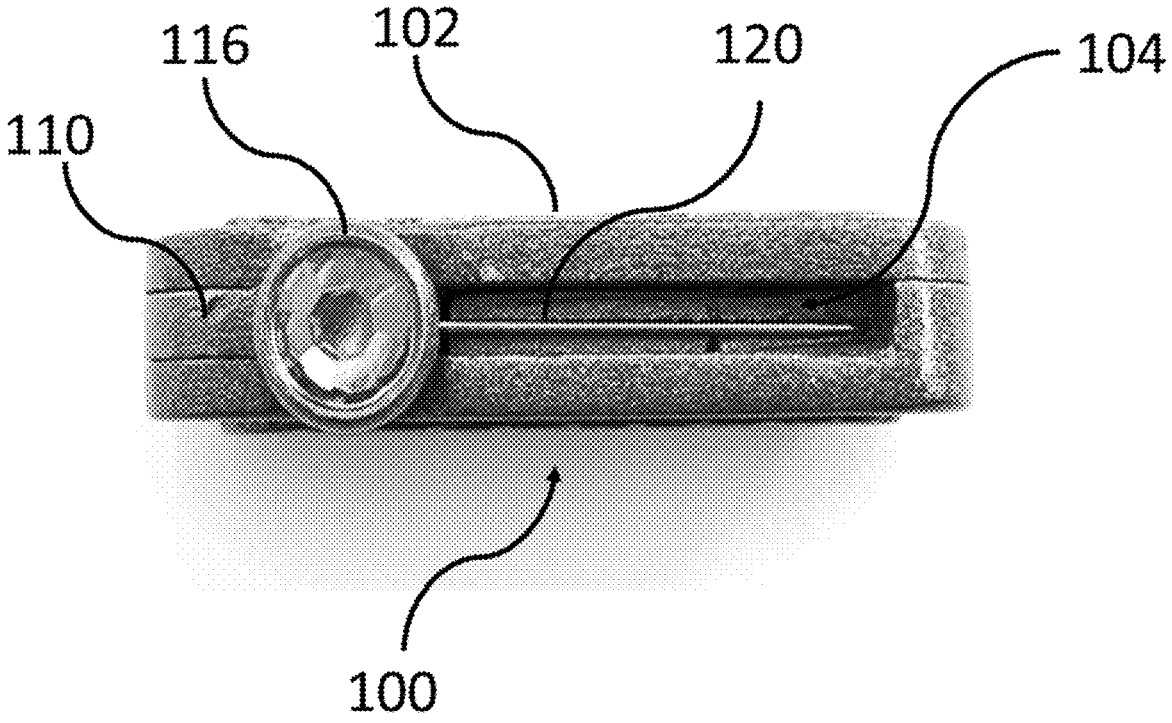
FIG. 2 depicts a top view of the exemplary embodiment of an eyelash separator in a closed position.
Figure 3:
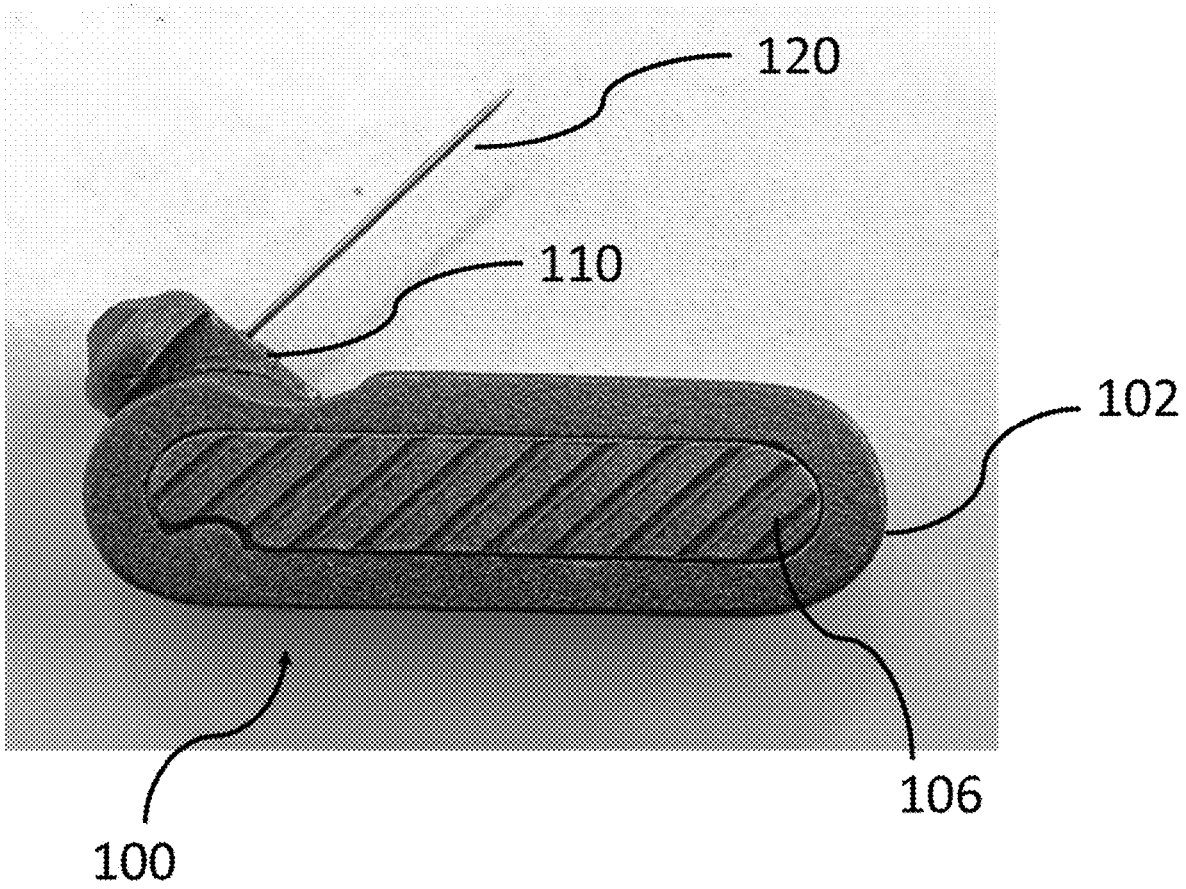
FIG. 3 depicts the exemplary embodiment in an open position of 45 degrees.
Figure 4:
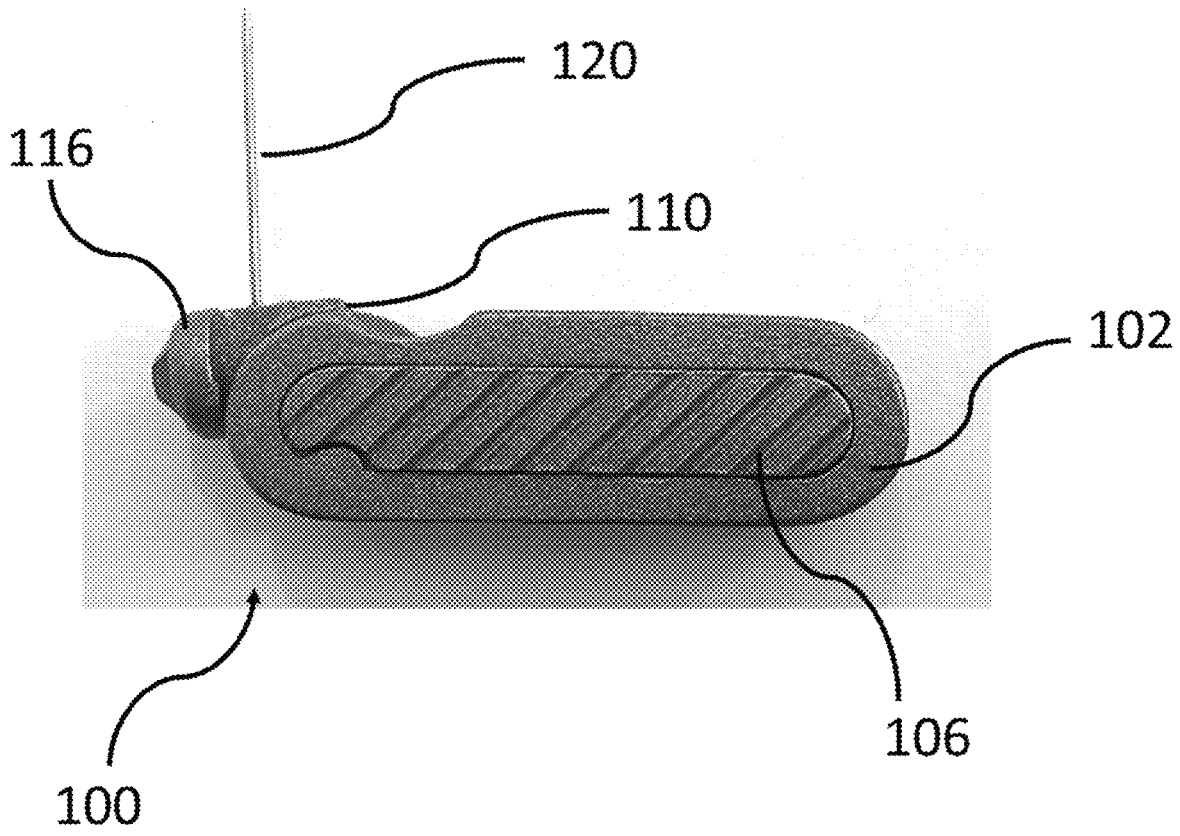
FIG. 4 depicts the exemplary embodiment in an open position of 45 degrees.
Figure 5:
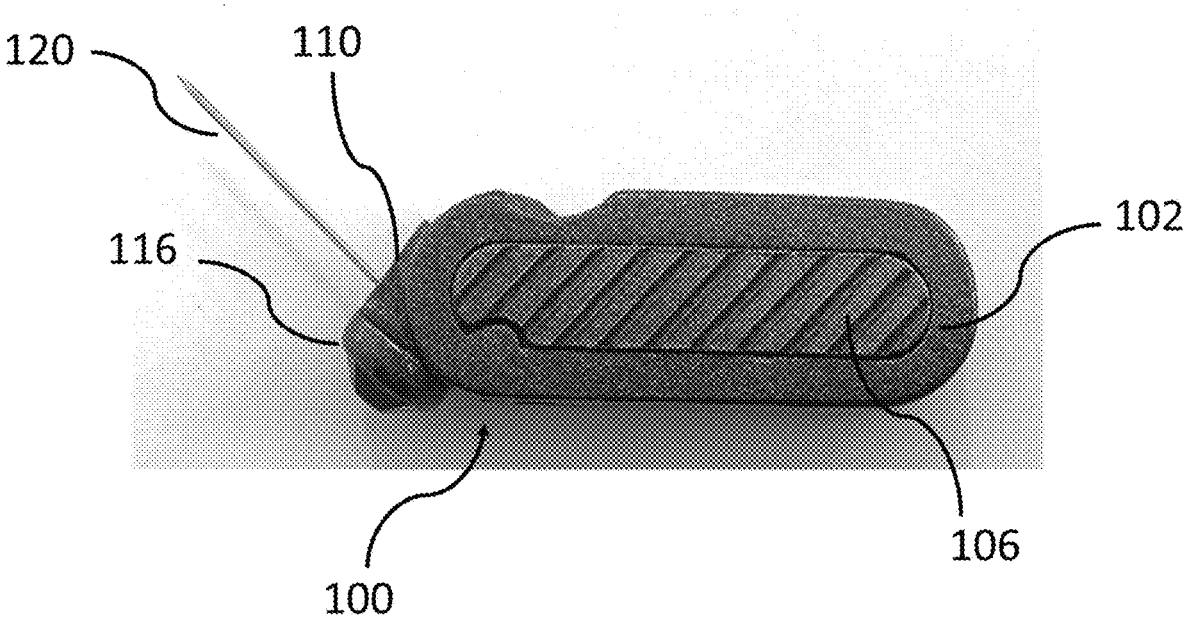
FIG. 5 depicts the exemplary embodiment in an open position of 135 degrees.
Figure 6:
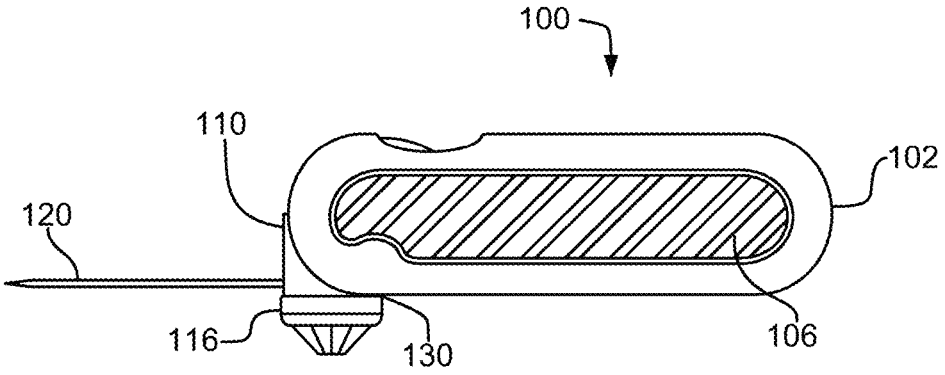
FIG. 6 depicts the exemplary embodiment in an open position of 180 degrees.
Figure 7A:
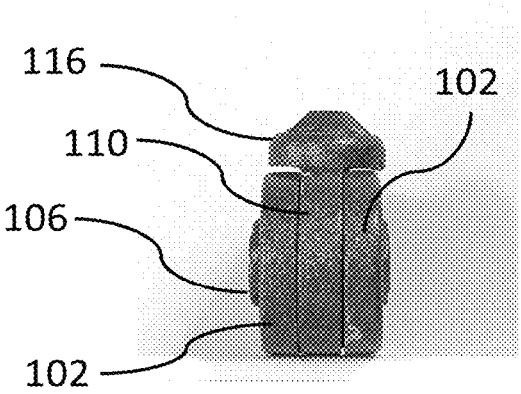
FIGS. 7A and 7B depict, respectively, left and right end views of the exemplary embodiment of FIG. 1.
Figure 7B:
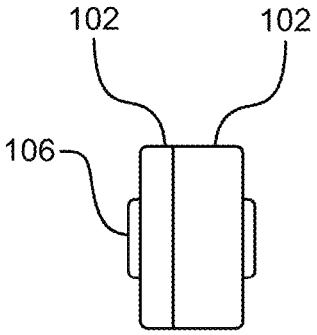

FIG. 2 depicts an exemplary embodiment of an eyelash separator 100 in a closed position. From the top position, the separator pin 120 can be viewed and is housed within a storage cavity 104 in the housing. The storage cavity may have any shape, contour, or design. In some embodiments, the storage cavity is a safety feature that surrounds the pin in a closed position and prevents accidental deployment of the pin and/or prevents a user from inadvertently grasping the pin or tip thereof. At a first end of the storage cavity, the tip of the pin is housed within the cavity. At a second end of the storage cavity, the base of the pin may be attached to a hinge 110 or intervening member which is in turn attached to a hinge 110. Therefore, the second end of the cavity may terminate with such a hinge 110 or intermediate member. The knob is generally attached to the hinge or intermediate member and it can be appreciated that the knob, hinge, and/or intermediate member may be formed as a single member that secures the base of the pin, and the combination of knob, hinge, and/or intermediate member may be alternatively referred to as the hinge member or pin base 110. In some embodiments, the storage cavity may further have one or more guides or clips that position the pin and/or assist in locking the device in a closed position so that it does not open unless desired. Guides or clips may be formed as a part of the housing or may be attached to the housing.

FIGS. 3-6 depict an exemplary embodiment of an eyelash separator 100 in a plurality of open positions. The figures show positions of 45 degrees, 90 degrees, 135 degrees, and 180 degrees. The angle is generally defined between the long dimension of the housing and the separator pin. It can be appreciated that any number of positions are contemplated, including continuous positioning from 0 degrees (closed) to 180 degrees (fully open). In some embodiments, the "fully open" position may be greater than 180 degrees. A device opening or deploying to a plurality of positions has specific advantages over a device having only one fully open position. Devices having only one fully open position typically involve a spring-loaded mechanism to hold the device in the open or closed positions. In-between the positions, the mechanism may exert pressure on a rounded lobe or other feature that serves to guide the deployed member into one of the two positions meaning that the intermediate positions are not available for or safe for use without unintended movement of the deployable member. Such mechanisms and devices, therefore, have limited flexibility with respect to safe placement of the deployable member for use near the eye. Alternatively, a device being configured to deploy the deployable member, i.e. pin, into a plurality of positions, can advantageously be used for safe positioning of the pin near the eye during use.

In some embodiments, the separator pin locks into one or more of the plurality of positions. The term "locks" means that the pin is held tightly in a particular position, but may be moved from the position by applying enough force. Alternatively, the pin can be said to be "positionable" into one or more positions, having the same meaning as "lockable" or as a description that the pin "locks". In-between the locked positions, the amount of force needed to move the pin is less than the amount of force needed to dislodge the pin from a locked position such that the amount of pressure needed to move the pin through its full range of motion is discontinuous. In embodiments where the pin locks in one or more positions, the locked positions may advantageously secure the pin in place during use so that the angle does not unexpectedly change. Therefore, the locked positions may be a safety feature. The device may have a lock at any one or more positions, including at 0 degrees (closed), 180 degrees or greater (fully open), or any position in between. A limit stop may prevent the pin from opening beyond its fully open position. In an embodiment, the limit stop 130 is a portion of the knob or projection which interferes with the side of the housing opposite the storage cavity. In an embodiment, the limit stop is an internal feature of the hinge or is a feature of the hinge member that interferes with an internal feature of the housing end having the hinge member. It can be appreciated that any limit stop is contemplated. Not counting the closed position, the pin may lock into one or more positions, or two or more positions, or three or more positions, or four or more positions, or five or more positions, or six or more positions, or seven or more positions, or eight or more positions, or nine or more positions. In an exemplary embodiment, the pin may lock into four positions not counting the closed position.

It can be appreciated that any mechanism which provides for locking the pin in one or more of a plurality of open positions (i.e. the locking mechanism) is contemplated. In an embodiment, the mechanism is a ball-and-click mechanism, where a spring-loaded ball or bearing engages with one or more holes in the pin base or hinge member. In further embodiments, the locking mechanism may have teeth or engaging features in the hinge, which may optionally have one or more spring elements for disengagement. In further embodiments, the locking mechanism may be a continuous-type locking mechanism where the hinge is held in a position by a brake or interfering feature unless a button is depressed to release the brake or interfering feature. In further embodiments, the locking mechanism may be a continuous-type locking mechanism where the hinge is free and continuously positionable until a switch or actuator is pressed to engage a brake or interfering feature.

The term "pin" or "separator pin" as used herein generally describes a deployable member having a shaft terminating in a tip. While the shaft and pin may take on various sizes, shapes, and configurations, the term "pin" excludes structures such as a corkscrew, screwdriver, knife, or any other structure which might be deployed from a cavity in certain unrelated devices.

Figure 8:
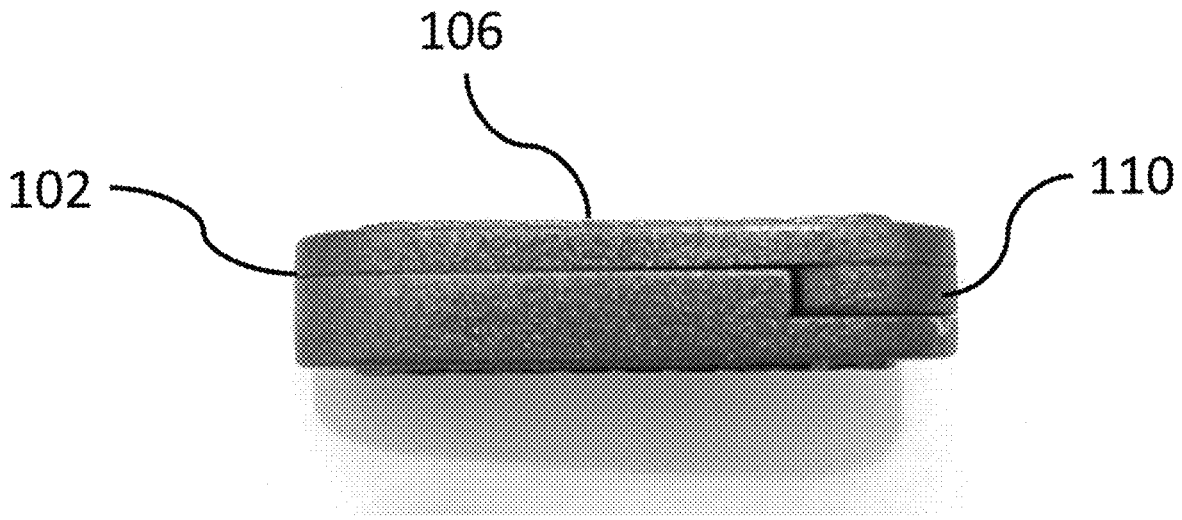
FIG. 8 depicts a bottom view of the exemplary embodiment.
Figure 9:
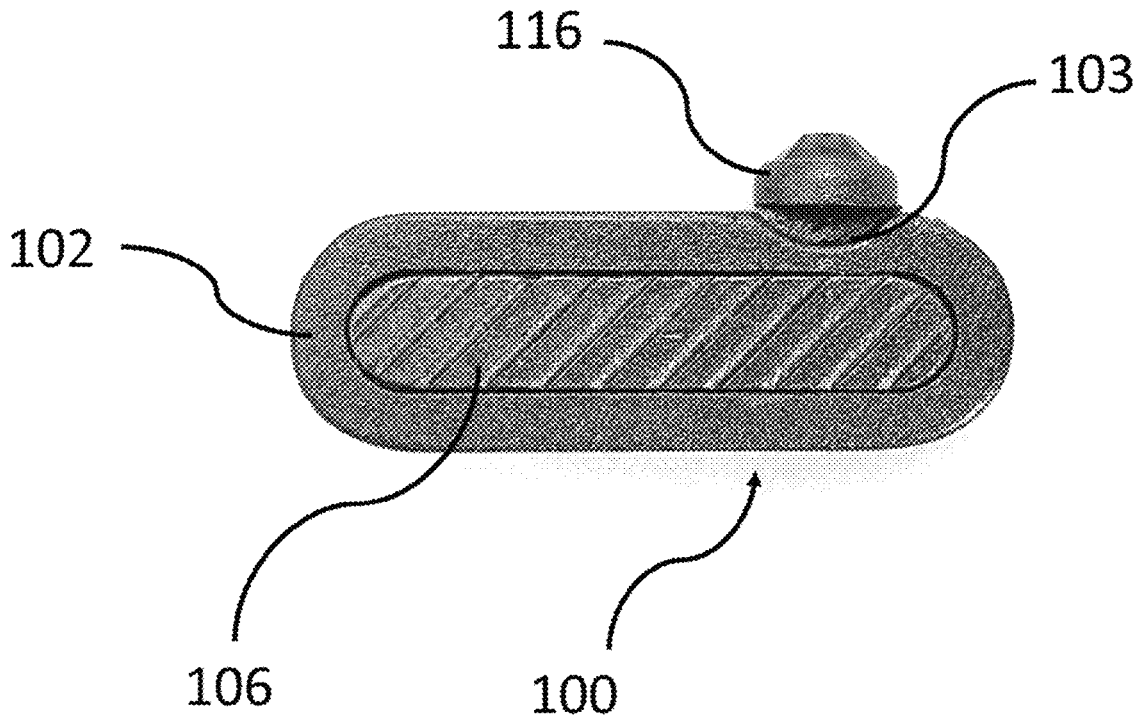
FIG. 9 depicts a back-side view of the exemplary embodiment.

FIGS. 7A, 7B, 8, and 9 depict further views of the exemplary embodiment of FIG. 1. From the end view of FIG. 7A, the hinge member 110 is sandwiched between two portions of the housing 102. During deployment of the pin, the hinge member 110 and projection 116 may pivot relative to the portions of the housing 102 that sandwich the hinge member 110. At the other end opposite the hinge member, as viewed in FIG. 7B, the two portions of the housing are coupled or held together by any appropriate means including adhesive, rivets, and screw fasteners. The bottom view of FIG. 8 shows that the hinge member 110 is pivotably sandwiched between two projections of the housing 102 such that the hinge member occupies a cut-out in one of two housing portions. For the remainder of the length of the embodiment, the two housing portions are coupled or held together by any appropriate means including adhesive, rivets, and screw fasteners. A back-side view, as depicted in FIG. 9, shows that the projection 116 is accessible by a depression or concave feature 103 in the housing 102.

Figure 10:
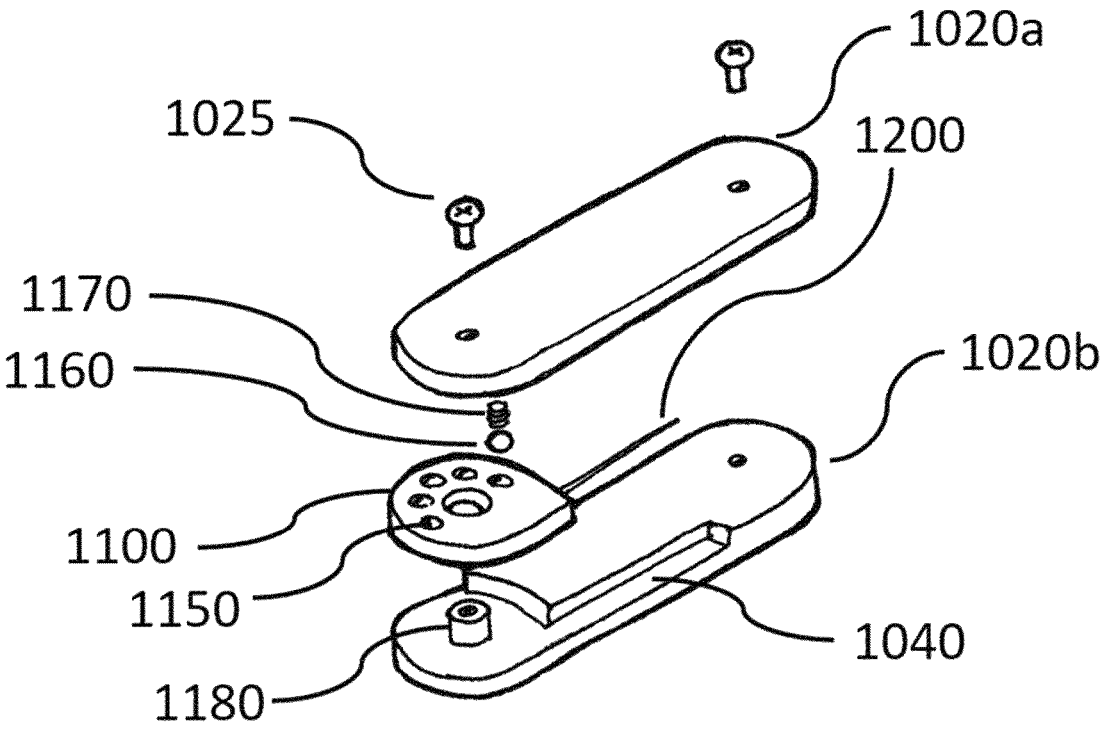
FIG. 10 depicts an exploded perspective view of an exemplary embodiment having a ball-and-click mechanism.

An exploded perspective view of an exemplary embodiment is depicted in FIG. 10. The embodiment has two housing portions, 1020*a* and 1020*b*, which form the outer portion of the eyelash separator device. One of the housing portions 1020*a* may be flat or may have the same thickness along its length. The other housing portion 1020*b* may have one or more raised or depressed regions to accommodate one or more features of the device, such as the hinge member 1100 or the pin 1200. Particularly, the hinge member 1100 may be contained within a depression in housing portion 1020*b* connected with an additional depression forming the cavity 1040 which contains the pin 1200. The hinge member 1100 may be contained upon a pivot projection 1180 such that the hinge member 1100 and pin 1200 may pivot relative to the housing portion 1020*b* around the pivot projection 1180. One or more positions or stops may be defined by a ball-and-click mechanism involving the hinge member 1100, a ball or bearing 1160, a spring 1170, and the housing portion 1020*a*. The hinge member may comprise one or more depressions or holes 1150 which engage with the ball 1160 to define one or more positions or stops. Any combination of positions or stops are contemplated, including closed position (0 degrees), 45 degrees, 90 degrees, 135 degrees, and 180 degrees.

In an assembled state, the housing portion 1020*a* is coupled with the hinge 1170 which is in turn coupled with the ball 1160 such that the spring and ball are not displaced when the hinge member 1100 is pivoted. When the hinge member is pivoted, the spring 1160 is compressed due to forces applied by the region of the hinge member in-between the depressions or holes 1150. Once the hinge member is pivoted to an extent that the ball may rest within a different depression or hole 1150, the spring is decompressed to press the ball into the depression or hole 1150 to define a stop or position. The ball-and-click mechanism may be configured so that the hinge member resists movement between positions when in use on an eyelash. Advantageously, in some embodiments, the ball-and-click mechanism does not place any load on the pin 1200 in-between its fully closed and fully open states, and the pin, in one of the one or more stop positions, is not under any forces which would act to move the pin to a different position if nudged slightly. In alternative embodiments, the spring 1170 and ball 1160 may instead be coupled with the other housing portion 1020*b* or may be in any other effective arrangement or configuration. In alternative embodiments, each housing portion 1020*a* and 1020*b* may comprise a ball and spring. The device may be assembled using any appropriate means to couple the housing portions 1020*a* and 1020*b* together, including screw fasteners 1025, adhesives, rivets, press-fit features and combinations thereof.

The separator pin may take on various sizes, shapes, and configurations without departing from the scope of the disclosure. Generally, the housing and particularly the storage cavity may be configured and dimensioned to accommodate the pin in a closed position. In an embodiment, such as depicted in FIGS. 3-6, the pin may be a straight pin tapering to a sharp 150 or blunted 152 point. In further embodiments, such as in the exemplary embodiments in FIG. 11, the pin may take on various further forms. In an embodiment, the pin may be curved or bent and/or the tip may be curved or bent 158. In an embodiment, the pin may have a hooked end 160 which is bladed or ends in a pointed tip. In an embodiment, the tip may be curved 158 or hooked 160 such that the tip is directed away from the user's eye while in use. In an embodiment, the tip of the pin may be a flattened and blade-like (i.e. blade-tipped) 156. In an embodiment, a blade tip may further be curved. In an embodiment, a blade tip may taper, in a dimension perpendicular to the length of the pin, to an edge that is sharp or blunted. In an embodiment, a blade tip may end in a point that is blunted or which may curve away from the user's eye when in use.

Figure 11:
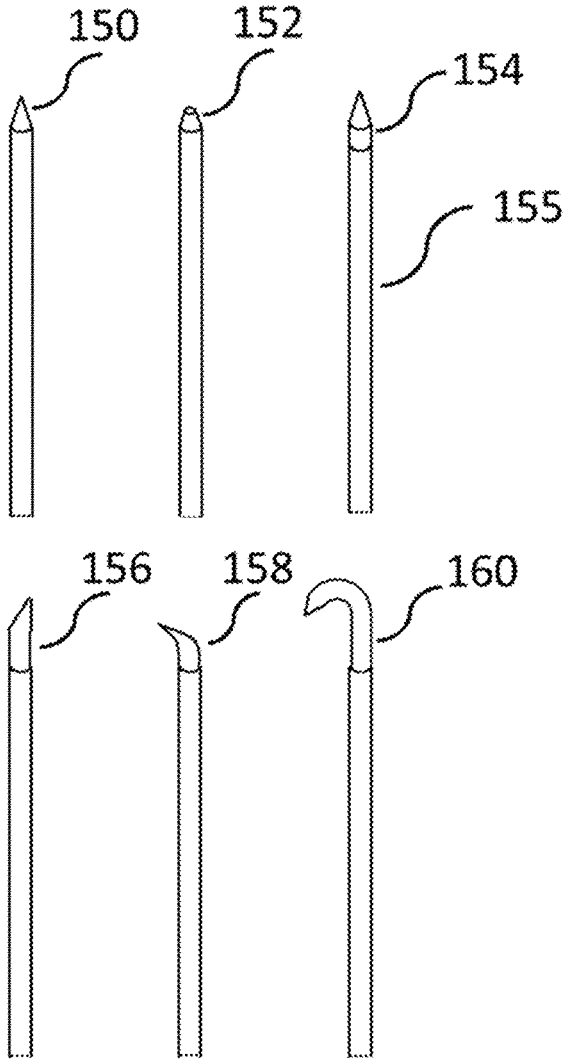
FIG. 11 depicts exemplary embodiments of pins.
Figure 12:
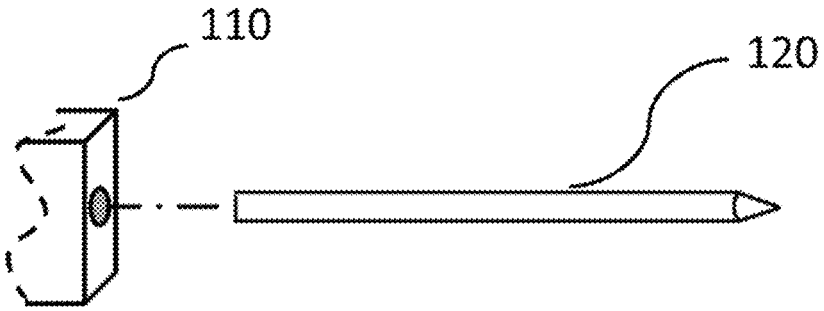
FIG. 12 depicts an exemplary embodiment of a pin removable from a hinge member or intermediate member.

In an embodiment, the pin is made from a metal or a sterilizable metal. In an embodiment, the pin is made from a steel, surgical steel, stainless steel, and steel alloys. In alternative embodiments, the pin is made from one or more materials, such as two different materials. In an embodiment, the tip of the pin may be constructed from a flexible material which enhances safety for use near the eye, while the remainder of the pin may be a metal or a rigid material. Such an example is shown in FIG. 11 having a flexible tip 154 and a rigid metal shaft 155. A flexible material may be rubber, silicon, polyethylene, or any other plastic material, and may be sterilizable. In an embodiment, the pin is coated with a sterilizable plastic. In an alternative embodiment, the pin is constructed from a rigid or semi-flexible plastic, optionally with a flexible tip. In an alternative embodiment, the pin is removable, or replaceable. In an embodiment, a kit is provided with one or more different tips as described herein which may be releasably engaged with the hinge member or pin base. As shown in FIG. 12, an exemplary embodiment may have one or more removable pins 120 that press-fit into a hinge member 110 having a cavity for accepting the removable pin. One or more pins may be provided, including the exemplary pins of the type shown in FIG. 7. The releasable engagement is not limited to press-fit and may have threaded engagement, releasable fasteners, or any other type of engagement which releasably secures the pin to the hinge member.

In an alternative embodiment, the device may have more than one pins. In an embodiment, a hinge is opposed at each end of the device and two separate pins are housed in the same storage cavity. In such an embodiment, the pins may be stored side-by-side. In an alternative embodiment, a hinge is opposed at each end of the device and two separate pins are each housed in separate storage cavities on opposing sides of the device. In embodiments having more than one pin, each of the pins can be different or identical. In one embodiment, a first pin may have a straight tip and a second pin may have a bent or bladed tip. Any combination of materials may be used to construct the two pins, as described herein.

In an embodiment, a method of use is provided for. In an embodiment, a user applies mascara using any known technique. Immediately after applying mascara, or after allowing the mascara to dry for a period of time (optionally with heat), the user uses the devices as disclosed herein to separate or de-clump one or more eyelashes, and/or to remove excess mascara. The user may first open the device from a closed position to any one of a plurality of open positions. With the device locked in an open position, the user may then identify an eyelash clump which would benefit from being separated or de-clumped, and/or identify excess mascara that would benefit from removal. The user then may insert the tip of the pin within or behind (closer to the base of the eyelash) the clump and/or the excess mascara. With the tip of the pin in place, the user may then carefully pull the pin away from the eye to break apart the clump, and/or carefully pull the pin away to remove the excess mascara. If necessary, the user may repeat on the same clump or may repeat the method on a different clump, and/or repeat on the same excess mascara or repeat the method on a different portion of excess mascara. The user may repeat the method any number of times until a desired appearance is obtained on one or both eyes. Once finished, the user may close the device, optionally after cleaning and/or sterilizing. It can be appreciated that at any point during use, the device may be positioned in different open positions depending upon the position of the clump and/or the excess mascara, or user preference. The user may clean and/or sterilize the pin before or after a session of using the device or, alternatively, in between each use of the device. It can be appreciated that any other known mascara application or personal care steps (such as blow-drying, mascara re-application, brushing steps, etc.) may interpose the method steps described and any implementation of the method steps in any order may be utilized for the purposes of the methods herein.

What is claimed is:

1. An eyelash separator, comprising:

a housing having an internal storage cavity on a top of the housing aligned with a pivot plane orthogonal to a pivot axis of a hinge member;

a pin coupled with the hinge member and pivotable along the pivot plane between a closed position and a plurality of open positions, the pin having a substantially cylindrical shaft terminating in a tip, wherein the pin is contained within the storage cavity of the housing in a closed position and deployed from the storage cavity in the plurality of open positions;

a projection disposed on the hinge member, the projection extending, in the closed position, vertically outwardly from the top of the housing and laterally outwardly from the hinge member and pin coupled thereto, wherein the pin is pivotable between the closed position and the plurality of open positions by force applied to the projection; and an internal mechanism including a spring arranged to apply force to a bearing in a direction substantially orthogonal to the pivot plane of the hinge member, to engage the bearing with one or more complementary holes or depressions disposed on an internal portion of the hinge member, the one or complementary holes or depressions releasably engaging with the bearing to locate the hinge member in at least one of the plurality of open positions.

2. The eyelash separator of claim 1, wherein the hinge member is disposed on a first end of the housing and a second end of the housing terminates beyond the end of the storage cavity.

3. The eyelash separator of claim 1, wherein the hinge member and pin coupled thereto are lockable in one or more positions defined by an angle between the housing and the pin along the pivot plane.

4. The eyelash separator of claim 3, wherein the hinge member and pin coupled thereto are lockable in one or more of the closed position, and the plurality of open positions defined by an angle of 45 degrees, 90 degrees, 135 degrees, or 180 degrees.

5. The eyelash separator of claim 1, wherein the hinge member and pin coupled thereto are positionable, by the internal mechanism, in one or more of the closed position and the plurality of open positions defined by an angle of 45 degrees, 90 degrees, 135 degrees, or 180 degrees between the housing and the pin along the pivot plane.

6. The eyelash separator of claim 1, wherein the pin is pivotable from the closed position to a fully deployed position, the fully deployed position defined by an interference of the projection with a bottom portion of the housing.

7. The eyelash separator of claim 6, wherein an angle along the pivot plane between the closed position and fully deployed position is about 180 degrees.

8. The eyelash separator of claim 1, wherein the housing, hinge member, and projection are each constructed from a material including one or more of plastic, metal, recycled plastic, biodegradable plastic, and wood.

9. The eyelash separator of claim 8, wherein the housing, hinge member, and projection are coated with a no-slip grip material.

10. The eyelash separator of claim 1, wherein the pin is formed of a material including one or more of metal, stainless steel, surgical steel, plastic, rubber, and silicon.

11. The eyelash separator of claim 10, wherein the tip is pointed, blunted, or bladed.

12. The eyelash separator of claim 11, wherein the shaft of the pin is formed of a metal, and the tip is formed from a flexible material.

13. The eyelash separator of claim 11, wherein the pointed tip terminating the substantially cylindrical shaft of the pin is conical in shape, and wherein the blunted tip terminating the substantially cylindrical shaft of the pin is frustro-conical in shape.

14. The eyelash separator of claim 10, wherein the pin is removably engaged with the hinge member.

15. A method comprising:

applying mascara to an eyelash, wherein the application of the mascara results in the formation of one or more eyelash clumps and/or results in excess mascara that requires removal;

opening an eyelash separator according to claim 1 from the closed position to any one of the plurality of open positions;

placing the pin behind or within a clump and/or the excess mascara; and pulling the device and pin away from the eyelash to break up the clump and/or remove the excess mascara.

16. A kit comprising:

an eyelash separator comprising:

a housing having an internal storage cavity on a top of the housing aligned with a pivot plane orthogonal to a pivot axis of a hinge member;

a pin removably engaged with the hinge member and pivotable along the pivot plane between a closed position and a plurality of open positions, wherein the pin is contained within the storage cavity of the housing in a closed position and deployed from the storage cavity in the plurality of open positions;

a projection disposed on the hinge member, the projection extending, in the closed position, vertically outwardly from the top of the housing and laterally outwardly from the hinge member and pin coupled thereto, wherein the pin is pivotable between the closed position and the plurality of open positions by force applied to the projection;

an internal mechanism having a spring arranged to apply force to a bearing in a direction substantially orthogonal to the pivot plane of the hinge member, to engage the bearing with one or more complementary holes or depressions disposed on an internal portion of the hinge member, the one or complementary holes or depressions releasably engaging with the bearing to locate the hinge member in at least one of the plurality of open positions; and one or more additional pins replaceable with the removably engaged pin, wherein the removably engaged pin and additional pins each have a substantially cylindrical shaft terminating in a tip.

17. An eyelash separator, comprising:

a housing having an internal storage cavity on a top of the housing aligned with a pivot plane orthogonal to a pivot axis of a hinge member;

a pin coupled with the hinge member and pivotable along the pivot plane between a closed position and a plurality of open positions, the pin having a substantially cylindrical shaft terminating in a tip;

wherein the pin is contained within the storage cavity of the housing in a closed position and deployed from the storage cavity in the plurality of open positions;

a projection disposed on the hinge member, wherein the pin is pivotable between the closed position and the plurality of open positions by force applied to the projection; and an internal mechanism including a spring arranged to apply force to a bearing in a direction substantially orthogonal to the pivot plane of the hinge member, to engage the bearing with one or more complementary holes or depressions disposed on an internal portion of the hinge member, the one or complementary holes or depressions releasably engaging with the bearing to locate the hinge member in at least one of the plurality of open positions.

18. The eyelash separator of claim 17, wherein the pin is pivotable from the closed position to a fully deployed position, the fully deployed position defined by an interference of the projection with a bottom portion of the housing.

* * * * *